US006729320B1

(12) United States Patent
Terry

(10) Patent No.: US 6,729,320 B1
(45) Date of Patent: May 4, 2004

(54) SHOOT THROUGH BOW STRING ARRANGEMENT FOR AN ARCHERY BOW

(75) Inventor: Edgell Terry, 1115 Shady La., Rome City, ID (US) 46784

(73) Assignee: Edgell Terry, Rome City, IN (US)

( * ) Notice: Subject to any disclaimer, the term of this patent is extended or adjusted under 35 U.S.C. 154(b) by 0 days.

(21) Appl. No.: 10/442,607

(22) Filed: May 21, 2003

(51) Int. Cl.[7] ..... F41B 5/10
(52) U.S. Cl. ..... 124/25.6
(58) Field of Search ..... 124/25.6, 86

(56) References Cited

U.S. PATENT DOCUMENTS 5,623,915 A 4/1997 Kudlacek ..... 124/25.6
5,694,914 A * 12/1997 Henschel
5,722,385 A * 3/1998 Bunk
6,371,098 B1 4/2002 Winther ..... 124/23.1
6,474,324 B1 11/2002 Despart et al. ..... 124/25.6

* cited by examiner

*Primary Examiner*—John A. Ricci
(74) *Attorney, Agent, or Firm*—Taylor & Aust, P.C.

(57) ABSTRACT

An archery bow includes a riser having a sight plane associated therewith. A pair of flexible limbs extend oppositely from the riser, with each limb having a distal end. A pair of rotating members are pivotally coupled to a respective distal end. A rotation controller includes a first saddle and a first string having opposite ends. The first string wraps the first saddle and the opposite ends are connected to a distal end of one of the limbs. The first string is located on opposite sides of the sight plane. A shoot through window includes a second saddle, a third saddle, and a second string wrapping each of the second saddle and the third saddle. The second string is located on opposite sides of the sight plane.

23 Claims, 2 Drawing Sheets

SHOOT THROUGH BOW STRING ARRANGEMENT FOR AN ARCHERY BOW

BACKGROUND OF THE INVENTION

1. Field of the Invention

The present invention relates to archery equipment, and, more particularly, to bow string arrangements in archery bows.

2. Description of the Related Art

Various types of archery bows have been developed, including traditional bows (i.e., long bows and recurved bows) and compound bows. All archery bows include a pair of opposed limbs extending from a riser or handle of the bow. As an archer draws the bow by pulling on a string, the limbs flex and store energy. This energy is transferred to the arrow as the archer releases the string.

A compound bow is a popular design for archery bows and includes one or more cams (for example, eccentric wheels or pulleys). Compound bows use a cable or string system which extends over at least one cam rotatably mounted at a distal end of a bow limb to provide a mechanical advantage during the drawback of the string. Such cams enable a peak draw force (i.e., a peak pull force on a drawstring of a bow to maintain a draw) to be reached in the middle of a draw such that the draw force drops at full draw.

With this arrangement, when the drawstring is in the full draw position, maximum potential energy is stored in the bow while the force required to maintain the drawstring in the full draw position is less than the maximum draw force of the bow. In short, as the drawstring is being drawn, the draw force applied to the bow increases to a maximum force and reduces to a lower draw force at the full draw position. Accordingly, maximum energy is stored in the limbs without requiring maximum force to be applied to the drawstring to hold the bow at the full draw position. This permits the archer to maintain aim on his target prior to release for a longer period of time for a better shot.

A general goal of compound bow designs is to provide a cable or string system that allows for fletching and sighting clearances. A fletching clearance is the area of clearance needed for the cross-sectional area of a bow shaft and radially extending fletching to pass unimpeded. A sighting clearance is a region for aiming at a target unimpeded by the cable or string system. The conventional method for establishing fletching and sighting clearances is to provide cable guards. However, the cable guards create unbalanced forces in the limbs which twist the limbs detrimentally.

Another method of providing flexing and sighting clearances is to configure the bow string arrangement with a so-called "shoot through" design. Such shoot through bow string arrangements may also include cable guards such as rods or the like which extend from the riser of the bow to deflect the bow strings laterally away from the trajectory path of the arrow, with resultant adverse effects as described above. Other types of shoot through arrangements attempt to move the bow strings laterally away from the trajectory path of the arrow by providing side-by-side multiple cams or idler pulleys which are likewise laterally displaced from the sighting plane associated with the trajectory path of the arrow. These bow string arrangements are complicated and expensive. For these reasons, shoot through bow string arrangements are not widely used.

An example of a shoot through bow string arrangement is disclosed by U.S. Pat. No. 6,474,324 (Despart, et al.). This type of shoot through design uses complicated cam arrangements (such as shown in FIGS. 17 and 21) to displace the bowstrings laterally away from the sight plane of the arrow. This type of cam arrangement is expensive and complicated. Moreover, this type of shoot through arrangement cannot be retrofitted to other types of existing bows.

Another example of a shoot through arrangement is disclosed by U.S. Pat. No. 5,623,915 (Kudlacek). This type of shoot through arrangement is used with a compound bow having a cam wheel at the distal ends of the limbs. A pair of spreader pins deflect the strings laterally away from the sight plane of the arrow. The laterally deflected strings are attached at their ends to the pivot shafts carrying the cams at the distal ends of the limbs. This type of arrangement work satisfactorily with a dual cam or so called "hatchet bow", but will not work with other types of bows. For example, a so called "solo cam" bow having a cam at one end and an idler pulley at the other does not allow the string returning from the idler pulley to be attached at the pivot shaft carrying the cam since the string returning from the idler pulley wraps around the secondary or smaller cam. For this reason, the shoot through arrangement disclosed by Kudlacek '915 is not used with a solo cam arrangement. Likewise, shoot through bow string arrangements have also not been used with a so called "cam and a half" bow, such as manufactured by Hoyt U.S.A.

What is needed in the art is a bow string arrangement for an archery bow that allows use as a shoot through bow with any cam arrangement.

SUMMARY OF THE INVENTION

The present invention provides a bow string arrangement for an archery bow that allows a shoot through configuration regardless of the type of compound bow, and without substantial alterations to other structural components of the bow.

The invention comprises, in one form thereof, an archery bow including a riser having a sight plane associated therewith. A pair of flexible limbs extend oppositely from the riser, with. each limb having a distal end. A pair of rotating members are pivotally coupled to a respective distal end. A rotation controller includes a first saddle and a first string having opposite ends. The first string wraps the first saddle and the opposite ends are connected to a distal end of one of the limbs. The first string is located on opposite sides of the sight plane. A shoot through window includes a second saddle, a third saddle, and a second string wrapping each of the second saddle and the third saddle. The second string is located on opposite sides of the sight plane.

An advantage of the present invention is that the shoot through bow string arrangement may be used with any compound bow, regardless of the configuration of cams and/or idler wheels.

Another advantage is that the bow string arrangement inhibits twisting or turning of the saddles regardless of whether the bow is at a rest position, drawn position, or other intermediate position.

A further advantage is that the strings associated with the rotation controller and the strings associated with the shoot through window are crisscrossed relative to each other to inhibit twisting or turning of the saddles.

Yet another advantage is that the saddles are wrapped by corresponding strings so that the strings and/or saddles may slightly slide relative to each other during movement of the bow limbs.

BRIEF DESCRIPTION OF THE DRAWINGS

The above-mentioned and other features and advantages of this invention, and the manner of attaining then, will become more apparent and the invention will be better understood by reference to the following description of an embodiment of the invention taken in conjunction with the accompanying drawings, wherein.

Corresponding reference characters indicate corresponding parts throughout the several views. The exemplification set out herein illustrates one preferred embodiment of the invention, in one form, and such exemplification is not to be construed as limiting the scope of the invention in any manner.

DETAILED DESCRIPTION OF THE INVENTION

Figure 1:
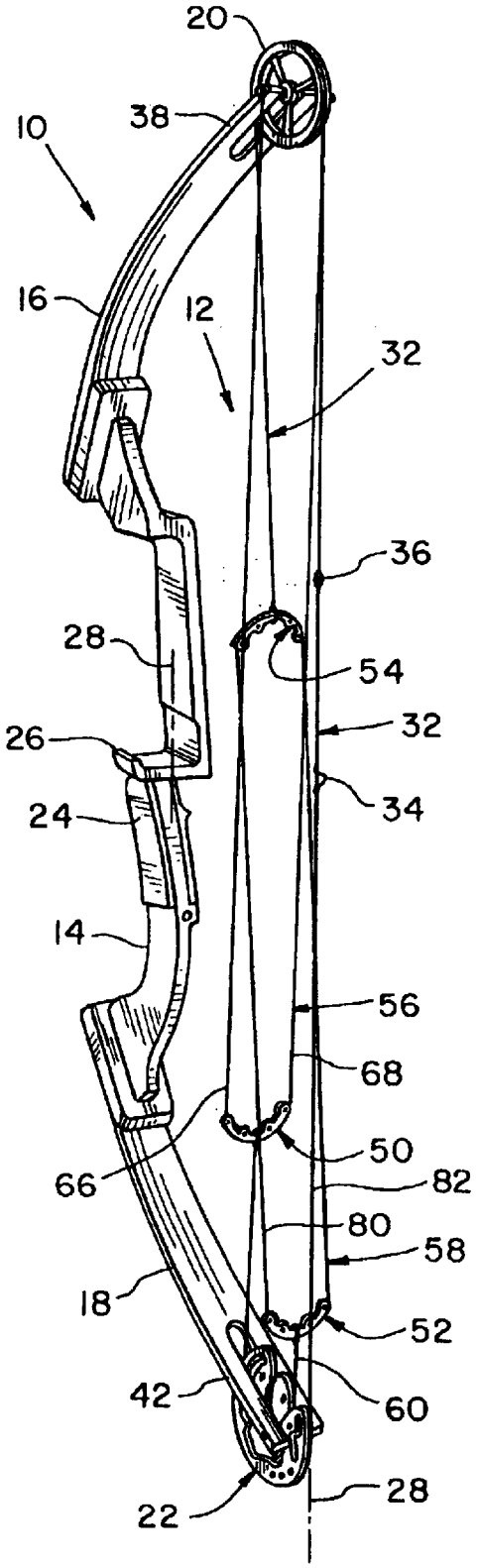
FIG. 1 is a perspective view of an archery bow including a bow string arrangement of the present invention.
Figure 2:
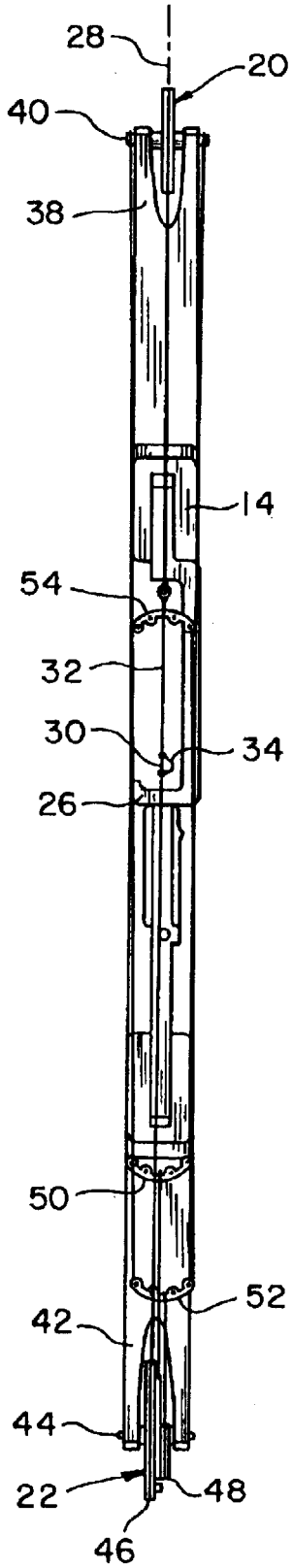
FIG. 2 is a rear view of the archery bow of FIG. 1.
Figure 3:
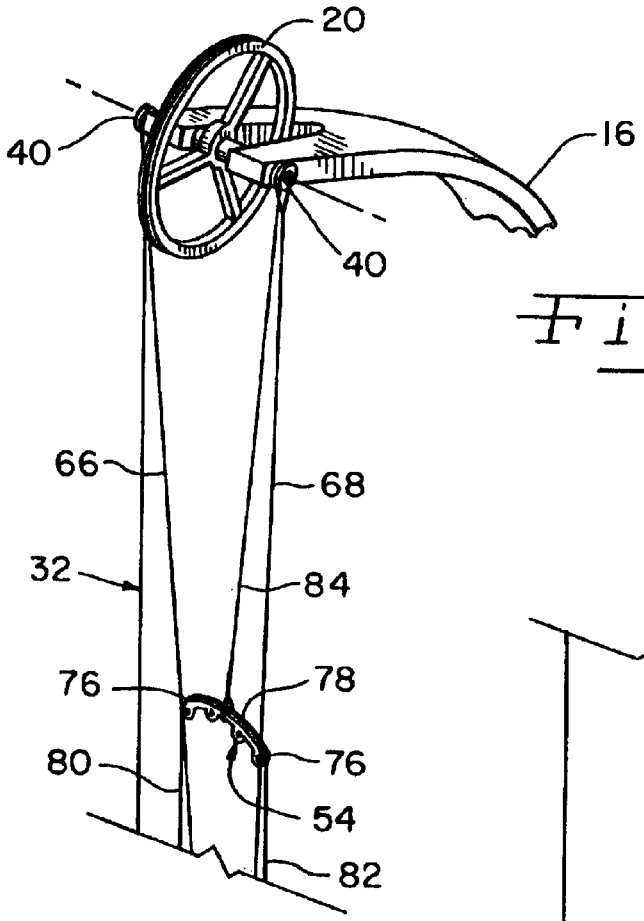
FIG. 3 is a fragmentary, perspective view of the upper limb of FIGS. 1 and 2.

Referring now to the drawings, and more particularly to FIGS. 1 and 2, there is shown an embodiment of an archery bow 10, including an embodiment of a bow string arrangement 12 of the present invention. Bow 10 also includes a riser 14, a pair of flexible limbs 16, 18, and a pair of rotating members 20, 22.

Riser 14 includes a handgrip 24 and an arrow rest platform 26. Multiple different types of arrow rests are available and may be associated with arrow rest platform 26, and thus are not shown in specific detail for simplicity sake. The arrow carried by the arrow rest defines a sight plane 28 corresponding to the trajectory path of the arrow. The base end of the arrow engages a nock location 30 on bow string 32. A nock set 34 is engaged by a hand release during use. It will thus be appreciated that bow string 32 also lies within sight plane 28 of the arrow. Sight plane 28 may be adjusted somewhat by laterally adjusting the arrow rest. A peep sight 36 carried by string 32 is typically aimed with respect to a sight pin (not shown) carried by riser 14.

Upper limb 16 is attached to the upper end of riser 14, and includes a distal end 38 to which rotating member 20 is pivotally mounted. More particularly, a pivot shaft 40 extending through distal end 38 of upper limb 16 pivotally carries rotating member 20.

Lower limb 18 is attached to the lower end of riser 14, and includes a distal end 42 which pivotally carries rotating member 22. More particularly, a pivot shaft 44 extending through distal end 42 pivotally carries rotating member 22.

Rotating members 20 and 22 may be of any suitable configuration for a compound bow for providing leverage and speed. In the embodiment shown, rotating member 20 is in the form of an idler pulley, and rotating member 22 is in the form of a cam. Cam 22 includes a primary cam 46 and a secondary cam 48. Idler pulley 20 and cam 22 carry bow string arrangement 12, as will be described in more detail hereinafter.

Referring now to all of the Figures, bow string arrangement 12 generally includes a first saddle 50, second saddle 52, and third saddle 54 which are carried in positions relative to sight plane 28 using a plurality of strings including a first string 56, second string 58, third string 60 and fourth string 32. Strings 56, 58, 60 and 32 as defined herein include one or more segments extending between structural components of bow string arrangement 12.

Figure 4:
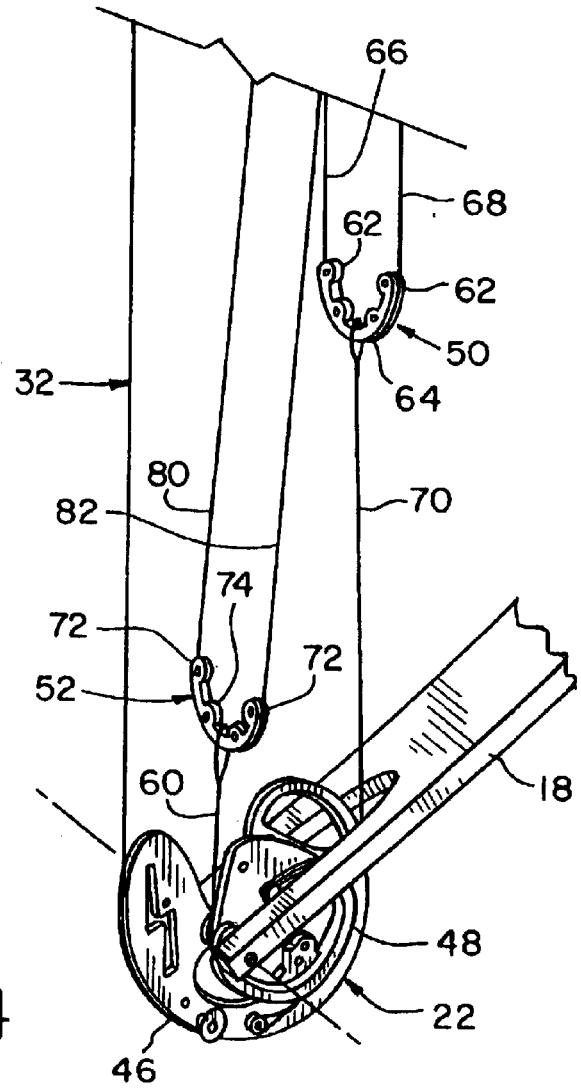
FIG. 4 is a fragmentary, perspective view of the lower limb of FIGS. 1 and 2.

First saddle 50 includes lateral ends 62 and a center portion 64 extending between lateral ends 62. First string 56 has a first string segment 66 extending between one lateral end and pivot shaft 40 at distal end 38, and a second string segment 68 extending between another lateral end 62 and pivot shaft 40 at distal end 38. More particularly, first saddle 50 has a peripheral groove formed in the rear surface (see FIG. 4). First string 56 is carried within the peripheral groove of first saddle 50 and wraps around first saddle 50. The opposite ends of first string 56 are attached to respective opposite ends of pivot shaft 40. String 32 includes a seventh string segment 70 attached to center portion 64 of first saddle 50. By attaching first string 56 to opposite lateral ends of pivot shaft 40 and placing first string 56 in tension, first saddle 50 is inhibited from rotating or turning during operation. Thus, first saddle 50 and first string 56 define a rotation controller for not only inhibiting rotation of first saddle 50 but also inhibiting rotation of second and third saddles 52 and 54 as will be described in more detail hereinafter.

Wrapping first saddle 50 with a single string 56 allows first saddle 50 to pivot slightly during use and first string 56 is allowed to move slightly relative to first saddle 50 during use. Alternatively, discrete string segments 66 and 68 may be individually attached to respective lateral ends 62 and pivot shaft 40. This configuration is possible but is not believed to be preferred.

Second saddle 52 and third saddle 54 are wrapped by the single second string 58. Second saddle 52, third saddle 54 and second string 58 define a shoot through window relative to sight plane 28.

More particularly, second saddle 52 includes lateral ends 72 and a center portion 74 extending between lateral ends 72. Similarly, third saddle 54 includes lateral ends 76 and a center portion 78 extending between lateral ends 76. Second string 56 includes a third string segment 80 extending between a lateral end 72 of first saddle 52 and a lateral end 76 of third saddle 54, and a fourth string segment 82 extending between the other lateral end 72 of second saddle 52 and the other lateral end 76 of third saddle 54. Third string segment 80 and fourth string segment 82 are preferably defined by a single second string 58 which wraps around and is carried within a peripheral groove formed in second saddle 52 and third saddle 54 as described above, but may also be configured as discrete string segments which are individually attached to lateral ends 72 and 76 of saddles 52 and 54.

As noted above, first string 56 and first saddle 50 define a rotation controller for inhibiting rotation of second saddle 52 and third saddle 54. More particularly, first string segment 66 and second string segment 68 define a control plane for inhibiting rotation of the shoot through window defined by second saddle 52, third saddle 54 and second string 58. Second saddle 52 is positioned on one side of the control plane defined by first string 56, and third saddle 54 is positioned on the opposite side of the control plane defined by first string 56. Second string 58 thus crisscrosses with first string 56. The crisscrossing and resultant scissor action between the shoot through window and the rotation controller inhibits rotation of the shoot through window during use.

At one end of the shoot through window, third string 60 defines a fifth string segment which attaches to center portion 74 of second saddle 52. The opposite end of third string 60 wraps around secondary cam 48 and is anchored to cam 22. At the opposite end of the shoot through window, fourth string 32 defines a sixth string segment 84 which attaches to center portion 78 of third cam 54. The shoot through window is thus placed in tension between fifth string segment 60 and sixth string segment 84. It will be appreciated that fifth string segment 60 is arbitrarily chosen as extending downward from the shoot through window and sixth string segment 84 is chosen as extending upward from the shoot through window for description purposes. Of course, the notation of which string extends upward or downward may be reversed and is only for description purposes herein.

During use, an arrow nock is engaged with nock location 30 on string 32 and the arrow is placed on the arrow rest. A hand release is typically engaged with nock set 34 and string 32 is drawn rearwardly away from riser 14 to a drawn position. As string 32 is moved to the drawn position, idler pulley 20 and cam 22 rotate and limbs 16, 18 flex. This causes the shoot through window defined by second saddle 52, third saddle 54 and second string 58 to move upwardly toward idler pulley 20. By placing second saddle 52 and third saddle 54 on opposite sides of the control plane defined by first string 56, the shoot through window is inhibited from rotating and remains open for the flight path of the arrow upon release of string 32.

Shoot through windows of conventional design require multiple anchor points for the strings and/or use deflector rods or other structures extending from the riser to inhibit the window from rotating and keep the window open during use. In contrast, bow string arrangement 12 of the present invention as described above may be used with virtually any compound bow arrangement regardless of the configuration of the rotating member such as cams or idler pulleys at the distal end of the limbs. A rotation controller of the present invention is merely attached to the distal end of one limb (such as at the pivot shaft as shown in the drawings) to inhibit rotation of the shoot through window. Since the shoot through window uses a pair of saddles with only a single string extending from the upper and lower saddle, the oppositely extending strings from the shoot through window may be engaged with any desired rotating member at the distal end of the limbs. Thus, the shoot through window of the present invention may be used with new archery bows or may be retrofitted to existing archery bows with no or minimal structural changes to the bow.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. An archery bow, comprising:

a riser having a sight plane associated therewith;

a pair of flexible limbs extending oppositely from said riser, each said limb having a distal end;

a pair of rotating members, each said rotating member pivotally coupled to a respective said distal end;

a first saddle having lateral ends;

first and second string segments respectively extending between said first saddle lateral ends and a distal end of one of said limbs, said first and second string segments located on opposite sides of said sight plane;

a second saddle and a third saddle, each having lateral ends and a center portion extending between said lateral ends;

third and fourth string segments, said third string segment extending between one said lateral end of said second saddle and one said lateral end of said third saddle, said fourth string segment extending between an opposite said lateral end of said second saddle and an opposite said lateral end of said third saddle, said third and fourth string segments located on opposite sides of said sight plane; and a fifth string segment extending between one said center portion and one of said rotating members.

2. The archery bow of claim 1, including a first string defining each of said first and second string segments.

3. The archery bow of claim 2, wherein said first string wraps said first saddle.

4. The archery bow of claim 1, including a pivot shaft at said distal end of said one limb, said first and second string segments each coupled with said pivot shaft.

5. The archery bow of claim 1, including a second string defining each of said third and fourth string segments.

6. The archery bow of claim 5, wherein said second string wraps each of said second saddle and said third saddle.

7. The archery bow of claim 1, including a third string defining said fifth string segment.

8. The archery bow of claim 7, wherein said third string wraps a portion of said one rotating member.

9. The archery bow of claim 8, wherein said one rotating member includes a cam, said third string anchored to said one rotating member and wrapping at least a portion of said cam.

10. The archery bow of claim 1, including a fourth string extending between an other said center portion and an other of said rotating members.

11. The archery bow of claim 10, wherein said other rotating member includes an idler pulley, said fourth string reverse wrapping said idler pulley.

12. The archery bow of claim 1, wherein each said rotating member comprises one of a cam and an idler pulley.

13. The archery bow of claim 12, wherein one of said rotating members comprises a cam and an other of said rotating members comprises an idler pulley.

14. An archery bow, comprising:

a riser having a sight plane associated therewith;

a pair of flexible limbs extending oppositely from said riser, each said limb having a distal end;

a pair of rotating members, each said rotating member pivotally coupled to a respective said distal end;

a rotation controller, including:

a first saddle and a first string having opposite ends, said first string wrapping said first saddle and said opposite ends connected to a distal end of one of said limbs, said first string located on opposite sides of said sight plane; and a shoot through window, including:

a second saddle, a third saddle, and a second string wrapping each of said second saddle and said third saddle, said second string located on opposite sides of said sight plane.

15. The archery bow of claim 14, wherein said first saddle includes opposite lateral ends, and said first string includes first and second string segments respectively extending between said first saddle lateral ends and a distal end of one of said limbs, said first and second string segments located on opposite sides of said sight plane.

16. The archery bow of claim 14, wherein said second and third saddles include opposite lateral ends and a center portion extending between said lateral ends, and said second string includes third and fourth string segments, said third string segment extending between one said lateral end of said second saddle and one said lateral end of said third saddle, said fourth string segment extending between an opposite said lateral end of said second saddle and an opposite said lateral end of said third saddle, said third and fourth string segments located on opposite sides of said sight plane.

17. The archery bow of claim 16, including a fifth string segment extending between one said center portion and one of said rotating members.

18. The archery bow of claim 14, wherein said first string defines a control plane, said second saddle disposed on one side of said control plane and said third saddle disposed on an other side of said control plane.

19. An archery bow, comprising:

a riser having a sight plane associated therewith;

a pair of flexible limbs extending oppositely from said riser, each said limb having a distal end;

a pair of rotating members, each said rotating member pivotally coupled to a respective said distal end;

a rotation controller, including:

a first saddle having lateral ends;

first and second string segments respectively extending between said first saddle lateral ends and a distal end of one of said limbs, said first and second string segments located on opposite sides of said sight plane; and a shoot through window, including:

a second saddle and a third saddle, each having lateral ends and a center portion extending between said lateral ends;

third and fourth string segments, said third string segment extending between one said lateral end of said second saddle and one said lateral end of said third saddle, said fourth string segment extending between an opposite said lateral end of said second saddle and an opposite said lateral end of said third saddle, said third and fourth string segments located on opposite sides of said sight plane.

20. The archery bow of claim 19, including a fifth string segment extending between one said center portion and one of said rotating members.

21. The archery bow of claim 19, including a sixth string segment extending between an other said center portion and an other said rotating member.

22. The archery bow of claim 19, wherein said first saddle has a center portion extending between said lateral ends, and including a seventh string segment extending between said center portion of said first saddle and said distal end of an other said limb.

23. The archery bow of claim 19, wherein said first and second string segments define a control plane, said second saddle disposed on one side of said control plane and said third saddle disposed on an other side of said control plane.

* * * * *